US005242007A

United States Patent [19]

Remmers et al.

[11] Patent Number: 5,242,007

[45] Date of Patent: Sep. 7, 1993

[54] X-RAY DETECTION OF RESIDUAL CERAMIC MATERIAL INSIDE HOLLOW METAL ARTICLES

[75] Inventors: Timothy M. Remmers, New Hartford; David R. Judd, South Windsor; Gerald S. Golden, Windsor, all of Conn.

[73] Assignee: United Technologies Corporation, Hartford, Conn.

[21] Appl. No.: 866,692

[22] Filed: Apr. 10, 1992

[51] Int. Cl.[5] ..... B22D 29/00; B22D 46/00

[52] U.S. Cl. ..... 164/4.1; 164/132; 164/529

[58] Field of Search ..... 164/132, 529, 369, 4.1

[56] References Cited

U.S. PATENT DOCUMENTS

| | | | |
|---|---|---|---|
| 2,812,562 | 11/1957 | Dalton | 164/72 |
| 3,617,747 | 11/1971 | Wilkinson et al. | 164/132 |
| 4,073,662 | 2/1978 | Borom | 164/132 |
| 4,802,195 | 1/1989 | Wojcienchowski et al. | 378/58 |
| 4,809,314 | 2/1989 | Steele et al. | 378/205 |

FOREIGN PATENT DOCUMENTS

| | | | |
|---|---|---|---|
| 0932076 | 8/1973 | Canada | 164/4.1 |
| 0237907 | 9/1986 | German Democratic Rep. | 164/4.1 |

*Primary Examiner*—Richard K. Seidel
*Assistant Examiner*—Jeffrey T. Knapp
*Attorney, Agent, or Firm*—George J. Romanik

[57] ABSTRACT

A hollow metal article can be made by casting a metal article around a ceramic core and leaching the core from inside the article. These steps form a hollow space in the shape of the ceramic core. An x-ray detectable agent that has a higher x-ray density than the ceramic core is introduced into the core. Any core remaining inside the article after the leaching step is detected by making and analyzing an x-ray radiograph of the article.

13 Claims, 1 Drawing Sheet

X-RAY DETECTION OF RESIDUAL CERAMIC MATERIAL INSIDE HOLLOW METAL ARTICLES

TECHNICAL FIELD

The present invention is directed to detecting residual ceramic material inside hollow metal articles.

BACKGROUND ART

To achieve higher performance from turbine engines, manufacturers have designed various parts to operate at higher temperatures. Although these parts are often made from superalloys that can tolerate high temperatures, cooling is critical to reliable operation. Various superalloys, including alloys of Ni and Ti, are well known in the aerospace industry. Turbine blades are one example of superalloy parts that require cooling. Typically, turbine blades have internal cooling passages that permit cooling air to flow though them.

The internal cooling passages in a turbine blade are formed by casting the blade around a ceramic core that can comprise $Al_2O_3$, $SiO_2$, and $ZrO_2$. The ceramic core is the pattern for the cooling passages. After the blade is cast, the ceramic core is leached out of the blade, leaving a hollow space inside the blade in the form of the cooling passages. The ceramic core is typically leached out of the blade with an aqueous solution of KOH.

Occasionally, parts of the ceramic core are not removed during the leaching step. Because even small parts of the core can block the cooling passages or cause other damage, none of the core can be left inside the turbine blades. Therefore, the blades must be inspected to ensure that the core was completely removed during the leaching step. Currently, turbine blades are inspected with a neutron radiographic method. First, the cooling passages in a blade are bathed in a Gd-containing solution to tag any residual ceramic core. Gd is a strong neutron absorber that highlights any residual ceramic core when exposed to neutrons. If any residual ceramic core is found in the blade, the Gd is washed out of the cooling passages and the leaching step is repeated.

Neutron radiographic inspection has several drawbacks. First, safety precautions required when dealing with a neutron source make the inspection very expensive. Second, only a few facilities are capable of performing the neutron radiographic inspection. If these facilities are not convenient to the blade manufacturing site, the blades must be shipped to the inspection facilities. This increases expenses and delays the manufacturing process. Third, neutron radiation makes the turbine blades slightly radioactive. As a result, the radioactivity in the blades must be allowed to decay to a safe level before further processing. This further delays the manufacturing process. Fourth, the Gd compound can be cumbersome to use. It can streak the walls of the cooling passages, creating false indications. After a false indication, the blade must be cleaned and reinspected. This adds further time and expense to the manufacturing process. The Gd also can interfere with later leaching steps needed to remove residual ceramic core.

Therefore, what is needed in the industry is a method for detecting residual ceramic core in turbine blades and other hollow metal articles that does not require neutron irradiation or Gd for tagging the residual core.

DISCLOSURE OF THE INVENTION

The present invention is directed to a method for detecting residual ceramic core in turbine blades and other hollow metal articles that does not require neutron irradiation or Gd for tagging the residual core.

The invention includes a method for making a hollow metal article. A metal article is cast around a ceramic core of an appropriate shape such that the ceramic core is embedded inside the metal article. The ceramic core is leached from inside the metal article to leave a hollow space in the shape of the ceramic core inside the metal article. The method is characterized by introducing an x-ray detectable agent into the ceramic core. The x-ray detectable agent has a higher x-ray density than the ceramic used to make the core. After the ceramic core is leached from inside the metal article, an x-ray radiograph of the metal article is made and analyzed to determine if any ceramic core remains inside the hollow space.

These and other features and advantages of the present invention will become more apparent from the following description and accompanying drawing.

BEST MODE FOR CARRYING OUT THE INVENTION

Figure 1:
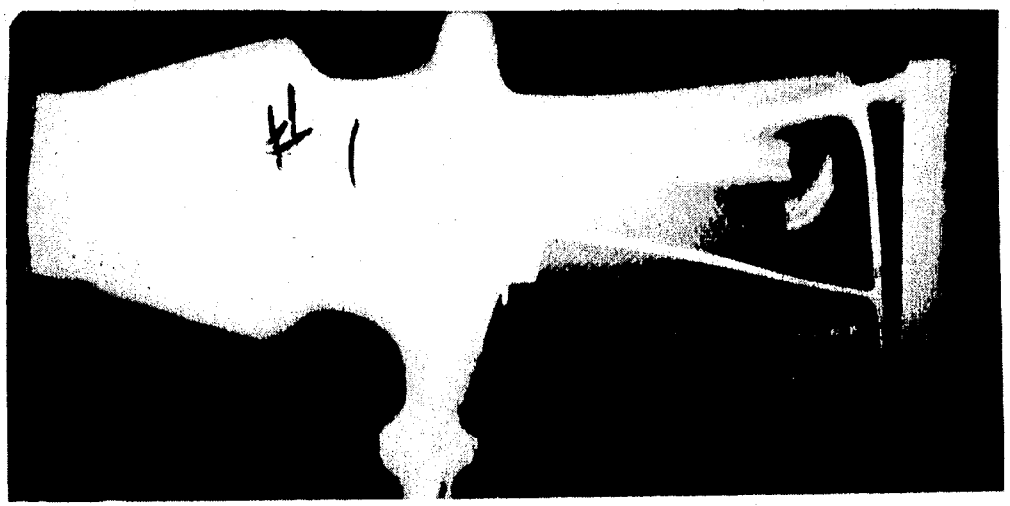
FIG. 1 is a radiograph of a turbine engine turbine blade with residual in its cooling passages.

The method of the present invention combines an x-ray detectable agent and conventional x-ray equipment to detect residual ceramic core inside a hollow metal article. The method is compatible with any hollow metal article made by casting the article around a ceramic core. It is particularly suited to hollow superalloy articles, such as turbine blades, in which no ceramic core can remain in the finished articles.

The x-ray detectable agent is a critical aspect of the invention. It must have a higher x-ray density than the ceramic used to make the core so the x-ray detectable agent will be more visible than the ceramic in an x-ray radiograph. Preferably, the x-ray detectable agent will have an x-ray density higher than the metal used to make the article. Suitable x-ray detectable agents can comprise an element with an atomic number greater than 56, such as W, Pb, Hf, Ta, Th, or U. For example, $Na_2WO_4$, $Pb(NO_3)_2$, and $HfO_2$ can be suitable x-ray detectable agents. Those skilled in the art will recognize that many more compounds also are suitable for use with the present invention.

The x-ray detectable agent can be used either as a doping agent or a tagging agent. In this application, the term doping agent refers to an x-ray detectable agent mixed with the ceramic material that forms the core. As a result, the doping agent is an integral part of the ceramic core. For example, a quantity of $HfO_2$ sufficient to make the core detectable by x-rays can be added to or replace some of the constituents of the ceramic. If the x-ray detectable agent is used as a doping agent, the metal article can be inspected immediately after leaching.

The term tagging agent refers to an x-ray detectable agent absorbed by parts of the ceramic core that remain inside the hollow metal article after leaching. The tagging agent should be very soluble in water or another solvent and form a soluble residue when it dries. $Na_2WO_4$, $Pb(NO_3)_2$, and $UO_2(NO_3)_2$ are among the compounds that meet these criteria. $Na_2WO_4$ is preferred because it also is soluble in the KOH solution used to leach the ceramic core from inside the hollow metal article. If the x-ray detectable agent is used as a tagging agent, the metal article must undergo a tagging step before inspection.

The tagging step can be any procedure that introduces the tagging agent into ceramic core that remains inside the metal article. For example, the article can be immersed in a saturated, aqueous solution of the tagging agent. The tagging agent solution can be at any temperature below its boiling point. Preferably, the tagging agent solution will be at higher than room temperature to increase the amount of tagging agent in solution. If practical, the article should be heated before it is immersed in the solution to avoid cooling the solution. The article should be oriented in the solution so any air tapped inside the article can escape. A light vacuum, such as that created by a water faucet ejector, can be applied over the tagging agent solution to help remove air trapped inside the article. The article should be left in the solution for a sufficient time for pores in any residual ceramic core to absorb the tagging agent. For example, the article can be left in the solution for at least about 2.5 min. Preferably the article should remain in the solution for at least about 5 min. The article should then be removed from the solution, washed to remove tagging agent from outside and inside the article, and thoroughly dried. Tagging agent absorbed by any residual ceramic core inside the metal article will not be washed away because pores in the core act like a sponge. Preferably, the tagging process will be repeated at least once to increase the amount of tagging agent absorbed by the residual core.

When the article is ready for inspection—after leaching if a doping agent is used and after tagging if a tagging agent is used—the article is exposed to x-ray radiation to make a radiograph. The radiograph can be made on conventional equipment with conventional techniques that are known to those skilled in the art. The particular exposure time, x-ray power, film type, and article orientation are functions of the article's geometry. For turbine blades, exposure times of about 60 sec to about 5 min with a tube distance between the x-ray source and film of about 90 cm to about 150 cm and an energy setting of about 120 kV to about 200 kV at 10 mA may be appropriate. Suitable films include those made by Agfa, Dupont, Kodak, and Fuji, which are commercially available from numerous sources. As many radiographs as needed to view the article adequately should be made. A person skilled in the art of reading x-ray radiographs will be able to identify the presence of residual ceramic core inside the article from the radiographs.

If any residual ceramic core is found, it is leached out of the article by repeating the leaching step. There may be no need to remove the x-ray detectable agent from the article before leaching if it is soluble in the leaching solution.

The following examples demonstrate the present invention without limiting the invention's broad scope.

EXAMPLE 1

Several turbine blades were cast around ceramic cores with conventional methods. The ceramic cores were partially leached out of the blades by immersing the blades in an aqueous KOH solution. The blades were removed from the KOH solution before leaching was completed to leave some of the ceramic core inside the blades. The blades were then x-ray radiographed to determine if the residual ceramic core could be detected. The radiographs were made with a Rich Seifert, Model US-2, 300 kV, glass tube x-ray machine at 160 kV and 10 mA for about 90 sec. The radiograph was made on Agfa D-4 film. One of the radiographs is shown as FIG. 1. Analysis of the radiographs showed that the residual ceramic core was either barely visible or not visible at all.

EXAMPLE 2

Figure 2:
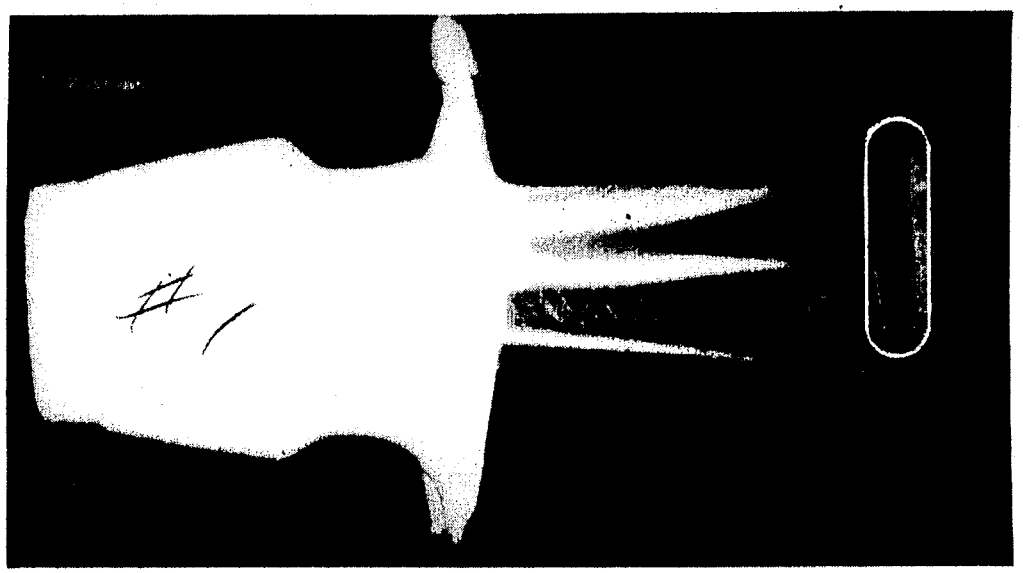
FIG. 2 is a radiograph of a turbine blade in which residual ceramic core in the cooling passages was tagged with $Na_2WO_4$. The $Na_2WO_4$ highlights exposed surfaces of the residual ceramic core, making the residual ceramic core more visible in the radiograph.

Some of the blades from Example 1 were tagged with $Na_2WO_4$ to determine if the residual ceramic core could be made more visible in x-ray radiographs. A saturated $Na_2WO_4$ solution was made by filling a desiccator with a 40% $Na_2WO_4$ aqueous solution, heating the solution to about 80° C., and adding enough $Na_2WO_4$ to form a precipitate. A blade heated to about 100° C. was immersed in the solution and oriented so air trapped inside it could escape. A slight vacuum was formed over the solution by attaching the desiccator to a water faucet vacuum ejector. The vacuum caused the solution to boil and helped remove air trapped inside the blade. After 5 min in the solution, the blade was removed, thoroughly washed to remove excess $Na_2WO_4$, and dried at 100° C. for 30 min. The tagging step was repeated once to ensure that a sufficient amount of $Na_2WO_4$ had been absorbed by the residual ceramic core. The blade was then x-ray radiographed as in Example 1. One of the radiographs is shown as FIG. 2. The residual ceramic core is visible as a white line around the edges of the residual core. The portion of the blade containing the residual ceramic core is indicated by the ellipse superimposed on the radiograph.

EXAMPLE 3

Example 2 was repeated using $Pb(NO_3)_2$ as the tagging agent instead of the $Na_2WO_4$. Results similar to those obtained in Example 2 were observed after the blade was x-ray radiographed.

The present invention provides several benefits over the prior art. First, it uses x-rays, rather than neutron radiation. Therefore, it avoids the problems inherent with the prior art neutron method. In particular, the safety precautions required for x-rays are much less stringent than those neutron radiation. In addition, x-rays do not make the inspected articles radioactive. Therefore, there is no need for the articles to "cool" after inspection. Moreover, the x-ray equipment needed for the method is readily available in many metal casting facilities.

Second, if the x-ray detectable agent is very soluble in water, as is $Na_2WO_4$, the problems of streaking and false indications can be virtually eliminated by thoroughly washing the article after the tagging step. This also can remove potential corrosive agents from the article. If the x-ray detectable agent is also soluble in the leaching solution, it will not interfere with the leaching step needed to remove residual ceramic core.

Third, the method of the present invention can cost significantly less than the neutron method. Additionally, inspections done with the method of the present invention can take much less time than inspections with the neutron method.

The invention is not limited to the particular embodiments shown and described herein. Various changes and modifications may be made without departing from the spirit or scope of the claimed invention.

We claim:

1. A method for making a hollow metal article, comprising the steps of casting a metal article around a ceramic core of an appropriate shape such that the ceramic core is embedded inside the metal article and leaching the ceramic core from inside the metal article to leave a hollow space in the shape of the ceramic core inside the metal article, wherein the method is characterized by:

(a) introducing an x-ray detectable agent into the ceramic core, wherein the x-ray detectable agent has a higher x-ray density than the ceramic used to make the core, (b) making an x-ray radiograph of the metal article after the ceramic core is leached from inside the metal article, and (c) analyzing the x-ray radiograph to determine if any ceramic core remains inside the hollow space.

2. The method of claim 1, wherein the x-ray detectable agent has a higher x-ray density than the metal used to make the article.

3. The method of claim 1, wherein the x-ray detectable agent comprises an element with an atomic number greater than 56.

4. The method of claim 1, wherein the x-ray detectable agent comprises W, Pb, Hf, Ta, Th, or U.

5. The method of claim 1, wherein the metal article is made from a superalloy.

6. The method of claim 1, wherein the metal article is a turbine engine turbine blade.

7. The method of claim 1, wherein the x-ray detectable agent is introduced into the ceramic core as a doping agent such that the x-ray detectable agent becomes an integral part of the ceramic core.

8. The method of claim 7, wherein the x-ray detectable agent comprises Hf.

9. The method of claim 1, wherein the x-ray detectable agent is introduced into the ceramic core after the leaching step as a tagging agent such that any ceramic core remaining inside the hollow space after the leaching step absorbs at least some of the x-ray detectable agent.

10. The method of claim 9, wherein the x-ray detectable agent is soluble in a basic aqueous solution used to leach the ceramic core from inside the metal article.

11. The method of claim 10, wherein the x-ray detectable agent is $Na_2WO_4$.

12. The method of claim 9, wherein the x-ray detectable agent is introduced into the ceramic core by:

(i) immersing the metal article in a solution of the x-ray detectable agent such that air trapped inside the hollow space can escape, (ii) applying a vacuum over the x-ray detectable agent solution to help remove air trapped inside the hollow space, (iii) leaving the metal article in the x-ray detectable agent solution for a sufficient time for pores in any ceramic core remaining inside the hollow space to absorb the x-ray detectable agent, and (iv) removing excess x-ray detectable agent from the metal article such that the x-ray detectable agent absorbed by any ceramic core remaining inside the hollow space is not removed from the metal article.

13. The method of claim 12, wherein steps (i) to (iv) are repeated at least one time.

* * * * *